US009208659B2

(12) United States Patent
Oosawa et al.

(10) Patent No.: US 9,208,659 B2
(45) Date of Patent: Dec. 8, 2015

(54) STRUCTURE FOR POSITIONING OPERATING UNIT

(75) Inventors: Toshimichi Oosawa, Gunma (JP); Katsuhiro Sawanaka, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 13/063,712

(22) PCT Filed: Jul. 5, 2010

(86) PCT No.: PCT/JP2010/061421
§ 371 (c)(1),
(2), (4) Date: Mar. 11, 2011

(87) PCT Pub. No.: WO2011/036929
PCT Pub. Date: Mar. 31, 2011

(65) Prior Publication Data

US 2011/0260024 A1 Oct. 27, 2011

(30) Foreign Application Priority Data

Sep. 23, 2009 (JP) ..... 2009-218323

(51) Int. Cl.
*A47B 96/00* (2006.01)
*G07F 19/00* (2006.01)

(52) U.S. Cl.
CPC ..... *G07F 19/205* (2013.01); *G07F 19/20* (2013.01)

(58) Field of Classification Search
CPC ..... G07F 19/00; G07F 19/205
USPC ..... 248/222.14, 200, 205.1, 220.21, 248/223.41, 224.51, 224.8, 224.61, 22.14
See application file for complete search history.

(56) References Cited

U.S. PATENT DOCUMENTS

| | | | | |
|---|---|---|---|---|
| 5,682,363 | A * | 10/1997 | Tsuchiya et al. | 369/30.74 |
| 7,134,127 | B2 * | 11/2006 | Aoki et al. | 720/619 |
| 8,081,139 | B2 * | 12/2011 | Schmidt et al. | 343/878 |
| 2006/0254996 | A1 | 11/2006 | McAfee | |
| 2009/0243320 | A1 * | 10/2009 | Taylor et al. | 296/35.1 |

FOREIGN PATENT DOCUMENTS

| | | | |
|---|---|---|---|
| JP | 2-113614 | U | 9/1990 |
| JP | 5-082757 | U | 11/1993 |
| JP | 07-230567 | A | 8/1995 |
| JP | 07-262672 | A | 10/1995 |
| JP | 2001-125502 | A | 5/2001 |
| JP | 2004-016401 | A | 1/2004 |

* cited by examiner

*Primary Examiner* — Todd M Epps
(74) *Attorney, Agent, or Firm* — Rabin & Berdo, P.C.

(57) ABSTRACT

A positioning structure, which fixes an operating unit (1) by a fixing bracket (4) and an adjusting bracket (2) provided with stoppers (3), easily performs the positioning that prevents the positions of the stoppers (3) from being displaced due to a customer's pressing force acted to the operating unit (1). Inclined rectangular holes (6) are formed at the adjusting bracket (2), and the adjusting bracket is fixable after fastening positions of fixing screws (5) are adjusted along the rectangular holes (6). Alternatively, step shaped rectangular holes (16) are formed, and the adjusting bracket is fixable after fastening positions of the fixing screws 5 are adjusted along the rectangular holes (16).

6 Claims, 4 Drawing Sheets

TOP VIEW

OPERATION ACTION OF PRESSING FORCE

SIDE VIEW

TOP VIEW

TOP VIEW

TOP VIEW

SIDE VIEW

STRUCTURE FOR POSITIONING OPERATING UNIT

TECHNICAL FIELD

The present invention relates to a structure for positioning an operating unit of an automatic transaction machine such as an automated teller machine (hereinafter, referred to as "ATM").

BACKGROUND TECHNOLOGY

An operating unit, which is to be operated by a customer, of an ATM includes a display unit and a touch panel. Further, in order to improve the detection accuracy of the touch panel, the touch panel and the display unit need to be disposed with no gap therebetween and need to be fixed to a main body of the ATM after the positions of the touch panel and the display unit are adjusted so as not to interfere with a front cover. A structure related to the position adjustment has been proposed (for example, see Patent Document 1 (Japanese Patent Application Laid-Open (JP-A) No. 7-230567)).

Further, in order to obtain a reaction force when a customer presses the touch panel, it is preferable that the back side of the operating unit be further pressed by stoppers.

Conventionally, the positioning structure has a configuration shown in FIG. 4. That is, an adjusting bracket 102 and stoppers 103*a* and 103*b* mounted on the adjusting bracket are disposed on the back side of an operating unit 101 in order to obtain a reaction force against the pressing of a customer in a direction of an arrow A.

Further, the adjusting bracket 102 is configured to be fixable to a fixing bracket 104 by fixing screws 105*a* and 105*b* that are mounted in rectangular holes 106*a* and 106*b*.

Furthermore, in order to position the operating unit 101 and the stoppers 103*a* and 103*b*, the fixing screws 105*a* and 105*b* are fixed to the fixing bracket 104 after the fastening positions of the fixing screws are adjusted in a direction of an arrow B along the rectangular holes 106*a* and 106*b* formed at the adjusting bracket 102.

DISCLOSURE OF THE INVENTION

Problems to be Solved by the Invention

However, in the above-mentioned conventional structure for positioning the operating unit, which acts as a holding force with respect to the customer's pressing force is only a holding force which is caused by a tightening force between the fixing bracket 104 and the fixing screws 105 for positioning the adjusting bracket 102. For this reason, there is a problem in that the positioning between the operating unit 101 and the stoppers 103 is displaced, when an external force equal to or larger than the tightening force is applied to the operating unit 101.

Means for Solving the Problems

The invention employs the following configuration in order to solve the above-mentioned problems. That is, in a positioning structure that fixes an operating unit by a fixing bracket and an adjusting bracket provided with stoppers, inclined rectangular holes are formed in the adjusting bracket, and the adjusting bracket is fixable after fastening positions of fixing screws are adjusted along the rectangular holes.

Effects of the Invention

According to the structure for positioning an operating unit of the invention, the positioning structure, wherein the operating unit is fixed by the fixing bracket and the adjusting bracket provided with the stoppers, is used. Further, the inclined rectangular holes are formed at the adjusting bracket, and the adjusting bracket is fixable after the fastening positions of the fixing screws are adjusted along the rectangular holes. For this reason, a necessary fixing force due to the tightening of the fixing screws can be reduced, and a proof stress for holding a positioning can be increased.

PREFERRED FORMS FOR EMBODYING THE INVENTION

Embodiments related to the invention will be described below with reference to the drawings. Elements common to the drawings are denoted by the same references.

First Embodiment

Configuration

Figure 1A:
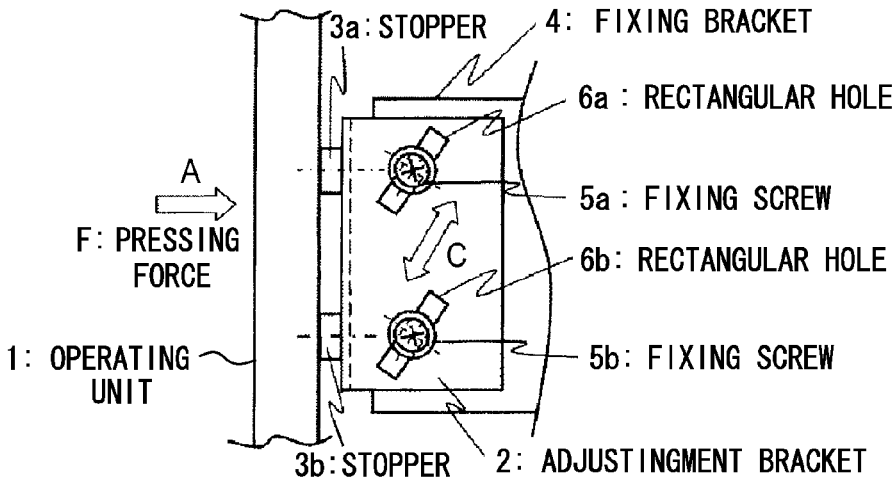
FIG. 1A is a view showing the configuration of a structure for positioning an operating unit according to a first embodiment.
Figure 1B:
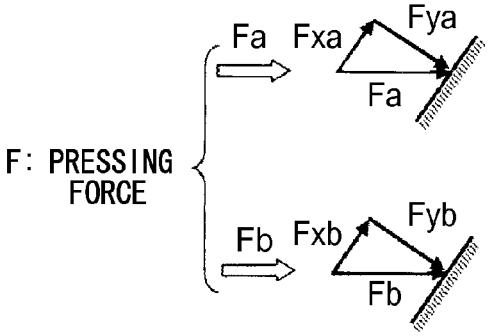
FIG. 1B is a view showing the configuration of the structure for positioning an operating unit according to the first embodiment.

FIG. 1 is a view showing the configuration of a structure for positioning an operating unit according to a first embodiment, FIG. 1A is a top view of the structure for positioning an operating unit according to the first embodiment, and FIG. 1B is a side view of the structure.

As shown in FIGS. 1A and 1B, in the structure for positioning an operating unit according to the first embodiment, an adjusting bracket 2 and stoppers 3*a* and 3*b* mounted on the adjusting bracket are disposed on the back side of an operating unit 1 in order to obtain a reaction force against the pressing of a customer in a direction of an arrow A.

Further, inclined rectangular holes 6*a* and 6*b* are formed at the adjusting bracket 2, and the adjusting bracket is configured to be fixable to a fixing bracket 4 by fixing screws 5*a* and 5*b* that are mounted in the rectangular holes 6*a* and 6*b*.

Operation

The structure for positioning an operating unit according to the first embodiment having the above-mentioned configuration is operated as follows. The operation of the structure will be described with reference to FIG. 1.

In the structure for positioning an operating unit according to the first embodiment, first, the adjusting bracket 2 is assembled as being temporarily fixed by the fixing screws 5 with a small gap between the operating unit 1 and the stoppers 3 mounted on the adjusting bracket 2. Subsequently, the fastening positions of the fixing screws 5 are adjusted in a direction of an arrow C along the inclined rectangular holes 6 that are formed at the adjusting bracket 2. Further, the stoppers 3 are abutted against the operating unit 1 and the fixing screws 5 are tightened so that the adjusting bracket 2 is fixed.

Figure 1C:
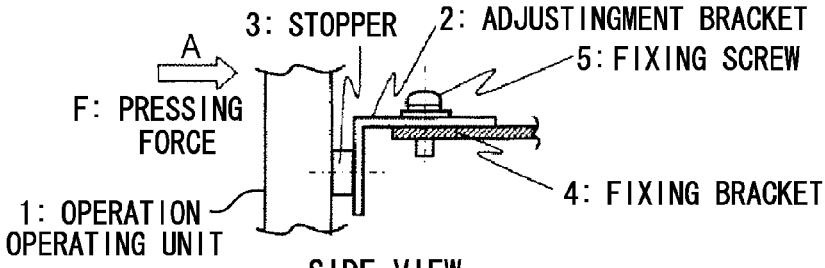
FIG. 1C is a view showing the configuration of the structure for positioning an operating unit according to the first embodiment.

Then, as shown in FIG. 1C, forces Fa and Fb are respectively generated to the fixing screws 5*a* and 5*b* due to a customer's pressing force F shown as the arrow A. However, since the rectangular holes 6 are inclined, the forces Fa and Fb are decomposed into forces parallel to the surface and forces vertical to the surface, that is, forces Fxa and Fya and forces Fxb and Fyb, respectively. Further, the normal forces Fya and Fyb are cancelled due to the abutment between the fixing screws 5*a* and 5*b* and the rectangular holes 6, and only the forces Fxa and Fxb are held by the fixing screws 5. For this reason, the proof stress for holding the fixing positions due to the fixing screws 5 is increased as compared to the conventional structure for positioning an operating unit.

Effects of First Embodiment

According to the structure for positioning an operating unit of the first embodiment as described in detail above, the positioning structure, which fixes the operating unit by the fixing bracket and the adjusting bracket provided with the stoppers, is used. Further, the inclined rectangular holes are formed at the adjusting bracket, and the adjusting bracket is fixable after the fastening positions of the fixing screws are adjusted along the rectangular holes. For this reason, a necessary fixing force due to the tightening of the fixing screws can be reduced and a proof stress for holding a positioning can be increased.

Second Embodiment

Configuration

Figure 2:
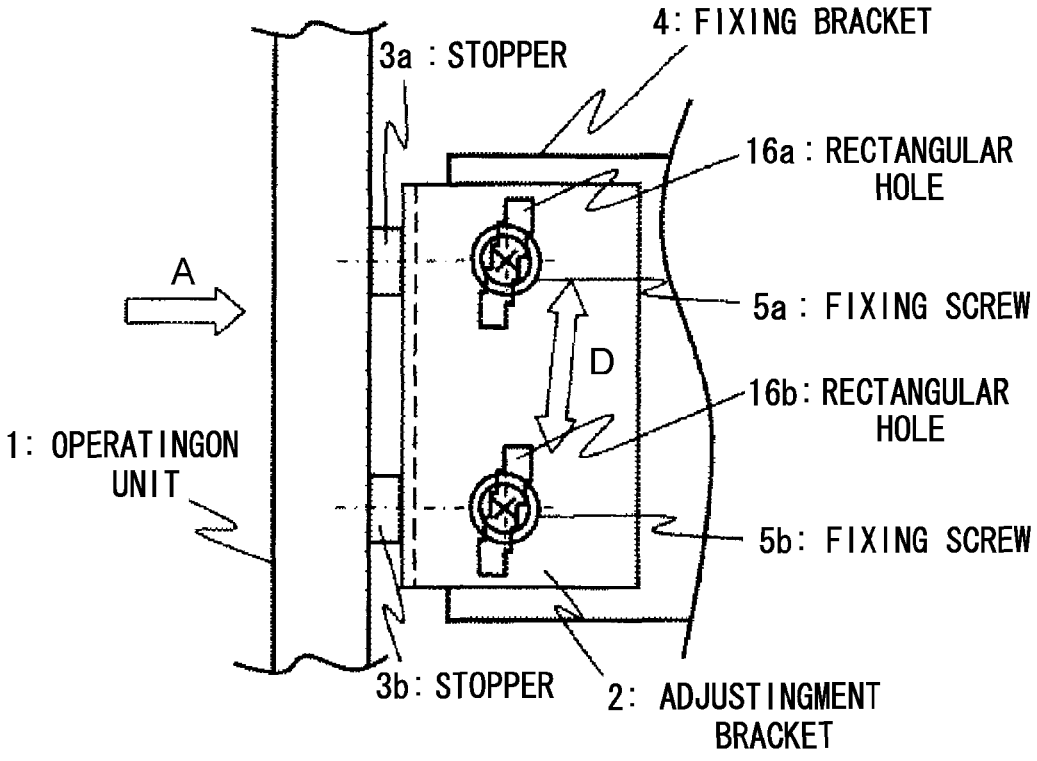
FIG. 2 is a view showing the configuration of a structure for positioning an operating unit according to a second embodiment.

FIG. 2 is a view showing the configuration of a structure for positioning an operating unit according to a second embodiment. Meanwhile, since the side view of the structure for positioning an operating unit according to the second embodiment is the same as in FIG. 1B that has been used in the first embodiment, the description thereof is omitted for simplification.

As shown in FIG. 2, in the structure for positioning an operating unit according to the second embodiment, an adjusting bracket 2 and stoppers 3*a* and 3*b* mounted on the adjusting bracket are disposed on the back side of an operating unit 1 in order to obtain a reaction force against the pressing of a customer in a direction of an arrow A.

Further, step shaped rectangular holes 16*a* and 16*b* are formed at the adjusting bracket 2. Furthermore, the adjusting bracket is configured to be fixable to a fixing bracket 4 by fixing screws 5*a* and 5*b* that are mounted in the rectangular holes 16*a* and 16*b*.

Operation

The structure for positioning an operating unit according to the second embodiment having the above-mentioned configuration is operated as follows. A description is to be given below with reference to FIG. 2.

In the structure for positioning an operating unit according to the second embodiment, first, the adjusting bracket 2 is assembled as being temporarily fixed by the fixing screws 5 with a small gap between the operating unit 1 and the stoppers 3 mounted on the adjusting bracket 2. Subsequently, the fastening positions of the fixing screws 5 are adjusted in a direction of an arrow D along the step shaped rectangular holes 16 that are formed at the adjusting bracket 2. Further, the stoppers 3 are abutted against the operating unit 1 and the fixing screws 5 are tightened so that the adjusting bracket 2 is fixed.

Then, forces Fa and Fb are respectively generated to the fixing screws 5*a* and 5*b* due to a customer's pressing force F shown as the arrow A. However, since the rectangular holes 16 are step shaped, the external forces Fa and Fb are vertically acted to the stepped surfaces of the rectangular holes 16. For this reason, the fixing screws 5 themselves function as stop members, so that it may be possible to reliably hold the positions fixed by the fixing screws 5.

Meanwhile, the stepped shape may correspond to the sizes of the fixing screws, and may be formed so that the diameter of a thread portion of the fixing screw is substantially equal to the length of one step.

Effects of Second Embodiment

According to the structure for positioning an operating unit of the second embodiment as described in detail above, the step shaped rectangular holes are formed at the adjusting bracket. Further, the adjusting bracket is fixable after the fastening positions of the fixing screws are adjusted along the rectangular holes. For this reason, it may be possible to further increase a proof stress that holds a positioning.

Third Embodiment

Configuration

Figure 3:
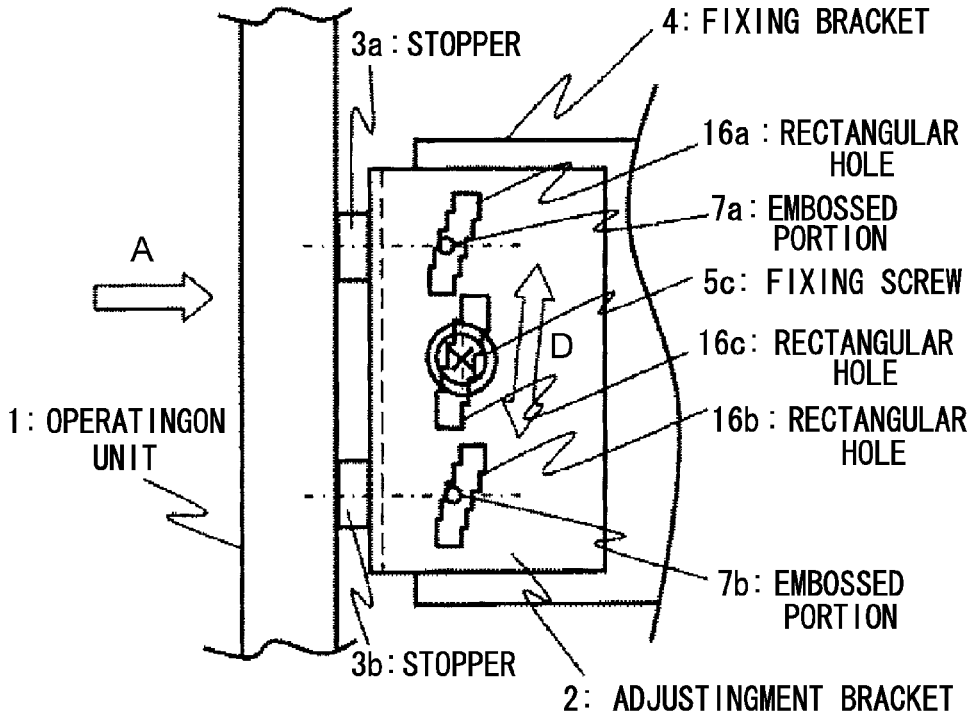
FIG. 3 is a view showing the configuration of a structure for positioning an operating unit according to a third embodiment.
Figure 4A:
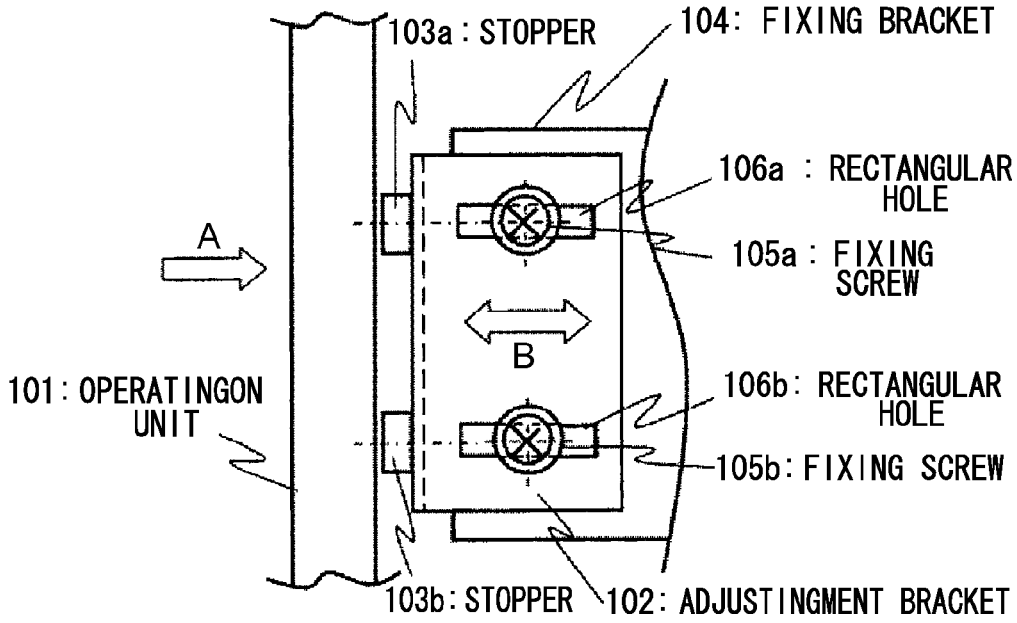
FIG. 4A is a view showing the configuration of a conventional structure for positioning an operating unit.
Figure 4B:
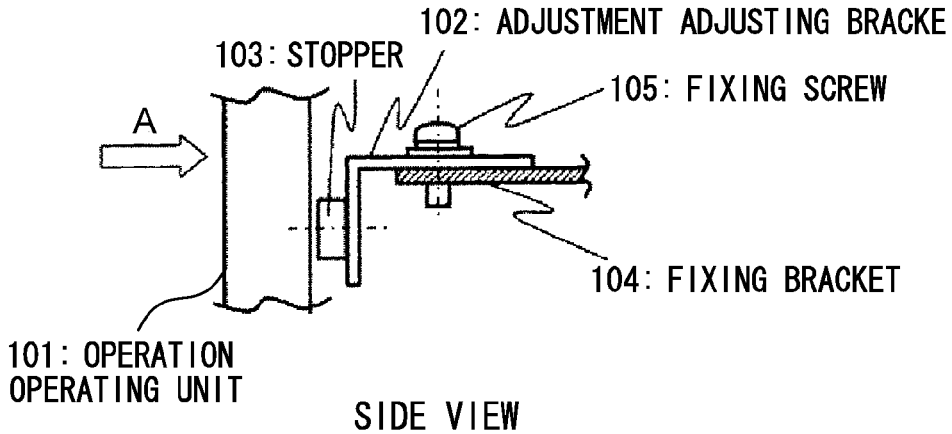
FIG. 4B is a view showing the configuration of the conventional structure for positioning an operating unit.

FIG. 3 is a view showing the configuration of a structure for positioning an operating unit according to a third embodiment. Meanwhile, since the side view of the structure for positioning an operating unit according to the third embodiment is the same as in FIG. 1B that has been used in the first embodiment, the description thereof is omitted for simplification.

As shown in FIG. 3, in the structure for positioning an operating unit according to the third embodiment, an adjusting bracket 2 and stoppers 3*a* and 3*b* mounted on the adjusting bracket are disposed on the back side of an operating unit 1 in order to obtain a reaction force against the pressing of a customer in a direction of an arrow A.

Further, step shaped rectangular holes 16*a* to 16*c* are formed at the adjusting bracket 2. Furthermore, embossed portions 7*a* and 7*b* are provided on a fixing bracket 4 at the positions of the rectangular holes 16*a* and 16*b*. Moreover, the adjusting bracket 2 is configured to be fixable to the fixing bracket 4 by a fixing screw 5*c* that is mounted in the rectangular hole 16*c* of the adjusting bracket 2.

Operation

The structure for positioning an operating unit according to the third embodiment having the above-mentioned configuration is operated as follows. A description is to be given below with reference to FIG. 3.

In the structure for positioning an operating unit according to the third embodiment, first, the adjusting bracket 2 is assembled as being temporarily fixed by the fixing screw 5*c* with a small gap between the operating unit 1 and the stoppers 3*a* and 3*b* mounted on the adjusting bracket 2. Subsequently, the embossed portions 7*a* and 7*b* are moved in a direction of an arrow D along the step shaped rectangular holes 16*a* and 16*b* that are formed at the adjusting bracket 2. Further, the stoppers 3 are abutted against the operating unit 1 and the fixing screw 5*c* is tightened so that the adjusting bracket 2 is fixed.

Then, forces Fa and Fb are respectively generated to the embossed portions 7*a* and 7*b* due to a customer's pressing force F shown as the arrow A. However, since the rectangular holes 16 are step shaped, the external forces Fa and Fb are vertically acted to the stepped surfaces of the rectangular holes 16. For this reason, the embossed portions 7*a* and 7*b* function as stop members, so that it may be possible to fix the adjusting bracket without an external force being acted to the fixing screw 5. Meanwhile, the stepped shape may be formed so that the diameter of the embossed portion is substantially equal to the length of one step.

In the above description, it has bee described that two embossed portions and one fixing screw are provided. However, more embossed portions and more fixing screws may be provided.

Effects of Third Embodiment

According to the structure for positioning an operating unit of the third embodiment as described in detail above, the step shaped rectangular holes are formed at the adjusting bracket. Further, the embossed portions are provided on the fixing bracket, and the adjusting bracket is fixable by the fixing screw after the positions of the embossed portions are adjusted along the rectangular holes. For this reason, it may be possible to reduce the force acted to the fixing screw, so that it may also be possible to prevent the breakage of the fixing screw.

INDUSTRIAL APPLICABILITY

As described above, the invention may be widely used for an automatic transaction machine such as an automated teller machine that needs to position an operating unit.

EXPLANATION OF REFERENCES

1: operating unit
2: adjusting bracket
3, 3*a*, 3*b*: stopper
4: fixing bracket
5, 5*a* to 5*c*: fixing screw
6, 6*a*, 6*b*, 16, 16*a* to 16*c*: rectangular hole
7, 7*a*, 7*b*: embossed portion

What is claimed is:

1. A structure, comprising:
an adjusting bracket;
a fixed bracket;
two or more inclined elongated holes formed parallel to each other on the adjusting bracket; and
two or more fixing screws, which are inserted through the two or more inclined elongated holes, respectively, and fix the adjusting bracket to the fixed bracket;
wherein a face of the adjusting bracket, at which the two or more inclined elongated holes are formed, is formed in a rectangular shape;
wherein the adjusting bracket is fixed to the fixed bracket after moving the adjusting bracket along the two or more inclined elongated holes, with a position of the two or more fixing screws remaining substantially same relative to the two or more inclined elongated holes;
wherein two or more inclined elongated holes are inclined relative to a direction of forces applied to the adjusting bracket; and
wherein the two or more fixing screws receive the forces applied to the adjusting bracket.

2. The structure for positioning an adjusting bracket according to claim 1, wherein the two or more inclined elongated holes are step shaped elongated holes, and the adjusting bracket is fixed to the fixed bracket after fastening positions are adjusted along the two or more inclined elongated holes.

3. The structure for positioning an adjusting bracket according to claim 1, wherein the two or more inclined elongated holes are step shaped elongated holes, embossed portions are formed at the fixed bracket, and the adjusting bracket is fixed to the fixed bracket after positions of the embossed portions are adjusted along the two or more inclined elongated holes.

4. The structure for positioning an adjusting bracket according to claim 1, wherein the structure for positioning an adjusting bracket also positions an operating unit.

5. The structure for positioning an adjusting bracket according to claim 4, wherein the adjusting bracket is provided with stoppers that receive pressing force from the operating unit.

6. The structure for positioning an adjusting bracket according to claim 5, wherein the stoppers are provided at the operating unit side.

* * * * *